US006118953A

United States Patent [19]

Hockey et al.

[11] Patent Number: 6,118,953

[45] Date of Patent: Sep. 12, 2000

[54] ELECTROSTATOGRAPHIC APPARATUS AND METHOD WITH PROGRAMMABLE TONER CONCENTRATION DECLINE WITH THE DEVELOPER LIFE

[75] Inventors: David E. Hockey, Brockport; Dennis E. DeMeyer; Kevin D. Lofftus, both of Rochester; Paul L. Nielsen, Lima, all of N.Y.

[73] Assignee: Eastman Kodak Company, Rochester, N.Y.

[21] Appl. No.: 09/156,821

[22] Filed: Sep. 18, 1998

[51] Int. Cl.[7] ..... G03G 15/10

[52] U.S. Cl. ..... 399/59; 399/43

[58] Field of Search ..... 399/59, 29, 30, 399/58, 62, 61, 43; 118/689, 690

[56] References Cited

U.S. PATENT DOCUMENTS

| | | | |
|---|---|---|---|
| 4,473,029 | 9/1984 | Fritz et al. . | |
| 4,546,060 | 10/1985 | Miskinis et al. . | |
| 4,671,646 | 6/1987 | Florack et al. . | |
| 4,734,737 | 3/1988 | Koichi . | |
| 4,875,078 | 10/1989 | Resch, III et al. . | |
| 4,908,666 | 3/1990 | Resch, III . | |
| 5,038,175 | 8/1991 | Sohmiya et al. . | |
| 5,081,491 | 1/1992 | Lux et al. . | |
| 5,387,965 | 2/1995 | Hasegawa et al. . | |
| 5,402,214 | 3/1995 | Henderson . | |
| 5,410,388 | 4/1995 | Pacer et al. . | |
| 5,436,705 | 7/1995 | Raj . | |
| 5,579,091 | 11/1996 | Yamada et al. | 399/59 |
| 5,634,174 | 5/1997 | Mori et al. . | |
| 5,649,266 | 7/1997 | Rushing . | |
| 5,669,037 | 9/1997 | Sugiyama . | |
| 5,678,131 | 10/1997 | Alexandrovich et al. . | |
| 5,724,627 | 3/1998 | Okuno et al. . | |
| 5,778,279 | 7/1998 | Kawai et al. . | |
| 5,946,524 | 8/1999 | Taniguchi | 399/59 |

FOREIGN PATENT DOCUMENTS

| | | |
|---|---|---|
| 3-161782 | 7/1991 | Japan . |
| 4-253078 | 9/1992 | Japan . |
| 5-188747 | 7/1993 | Japan . |

OTHER PUBLICATIONS

Japanese Patent Application 05–249832 to Nakamaru et al Sep. 28, 1993).

*Primary Examiner*—Robert Beatty
*Attorney, Agent, or Firm*—Norman Rushefsky

[57] ABSTRACT

In an electrostatographic process and apparatus a replenishment device adds toner particles to a development station that includes a developer comprising a mixture of toner particles and carrier particles. A reference parameter that is used in control of aim point of toner concentration in the mixture is set to an initial value until about a midlife of the developer is reached. Once the midlife of the developer is reached there are provided programmed step adjustments in the reference value in accordance with further increases in life of the developer to thereby control replenishment of toner particles so that control of charge to mass of the toner particles in the mixture is provided to reduce a tendency of dusting by the toner particles of the mixture due to age of the developer.

18 Claims, 7 Drawing Sheets

ELECTROSTATOGRAPHIC APPARATUS AND METHOD WITH PROGRAMMABLE TONER CONCENTRATION DECLINE WITH THE DEVELOPER LIFE

BACKGROUND OF THE INVENTION

1. Field of the Invention

This invention relates to the field of electrostatography, and more particularly, to improvements in a method and apparatus for controlling toner replenishment.

2. Description of the Prior Art

Toning or development stations for electrostatographic apparatus such as electrophotographic (EP) copiers and printers typically have two-component developer mixtures (carrier and toner). Toner depleted by toning latent images on the photoconductor must be replaced by replenishing with new toner, so that the toner concentration (TC) remains within a usable range in the toning station developer mix.

Closed-loop toner concentration control, for example see U.S. Pat. No. 4,875,078, is typically achieved by means of a TC monitor and control logic to drive a toner replenishment mechanism. TC monitors are of several types, including optical and magnetic. As noted in U.S. Pat. No. 5,649,266, one common practice is to adjust the monitor output, $V_{MON}$, to 2.500V when a new load of developer at nominal 10% concentration is installed in the development station. The replenishment algorithm then acts to regulate $V_{MON}$ to this initial 2.500V value. Maintaining $V_{MON}$=2.500V assures that TC=10% (barring monitor drift) regardless of TC monitor sensitivity.

For a given developer at a particular point in its life, as toner charge increases the toner charge to mass ratio (Q/m) decreases, and vice versa. Best system performance is observed when the toner Q/m is within a particular range. An example of a range for one application may be the range of 17–23 $\mu$C/g. Problems arise when the ratio of Q/m migrates above or below the particular range suited for that particular application. Examples of problems that occur when the Q/m ratio is low are the tendency towards excessive dusting, hollow character, and post transfer image disruptions. The term "dusting" implies uncontrolled migration of toner to other parts of the apparatus outside of the development station as distinguished from controlled movement of toner to the primary image-forming member to develop the electrostatic image. It is also found that at a given Q/m ratio, higher toner concentrations will give elevated levels of print background.

Typically, problems with Q/m ratios that are low arise through aging of the developer. However, the art has recognized that outright replacement with new developer is an undesirable expensive solution. Accordingly, one known approach for overcoming this problem is described in U.S. Pat. No. 5,678,131 (Alexandrovich et al.). In Alexandrovich et al., a process control procedure is described for regulating toning contrast (D/V). At intervals in an EP process, process control patches are exposed and toned so that an electrometer and a densitometer may read the parameters of voltage and density on the photoconductor. Toning contrast is then computed and compared to the desired value for toning contrast. When the developer is relatively fresh, there is a direct relationship between TC and D/V and the TC setpoint can be adjusted according to the error in D/V. Alexandrovich et al, however, indicates that the rate of adjustment of the TC setpoint is made to be limited so that the change in TC is very gradual. Short term variations in density can be controlled by immediate adjustments in charging and/or exposure while long-term changes are compensated by the gradual adjustment of TC. Further adjustment is made to the rate of adjustment of TC to compensate for the aging of the developer. The problem with this approach is the requirement of multiple readings to infer the toning contrast. The approach can be fairly complex to implement into an electrophotographic apparatus. Each of the measurements will inherently have some error in the desired relationship between TC and the optimum D/V. This approach also requires a toner monitor sensor with a large dynamic range to enable sensing of TC over a large range with adequate linearity.

SUMMARY OF THE INVENTION

It is therefore an object of the invention to provide for control in variability of the Q/m ratio in a development station, particularly to control dusting, hollow character, print background, and post transfer image disruptions at low Q/m ratios of toner in development stations without requiring that adjustments be made when the developer is still new. It is also an object of this invention to provide this function without the need for multiple measurements in the EP process as a means to direct the adjustments to control the Q/m ratio in order to simplify the control algorithm and reduce the propensity for errors. This is accomplished by using the known aging characteristics of the toner/developer system used in a particular electrostatic apparatus. The algorithm described has sufficient flexibility to allow it to be tuned for unique aging characteristics of toner/developer systems.

In accordance with the invention, there is provided for use in an electrostatographic machine wherein images are formed on an electrostatic image supporting medium and developed by a development station having a developer formed of a mixture of toner particles and carrier particles and a replenishment device for adding toner particles to the mixture, the machine including apparatus for controlling charge to mass of the toner particles in the mixture, the apparatus comprising a controller that is operational to control a reference parameter used in control of concentration of toner in the mixture, the controller controlling the reference value to an initial value until about a predetermined life of the developer is reached, the controller being programmed to provide adjustments in the reference value in accordance with further increases in life of the developer and in response to the adjustments the controller controls the replenishment of toner particles by the replenishment unit to control charge to mass of the toner particles in the mixture to reduce a tendency of dusting by the toner particles in the mixture due to age of the developer.

In accordance with a second aspect of the invention, there is provided a method for use in an electrostatographic process wherein images are formed on an electrostatic image supporting medium and developed by a development station having a developer formed of a mixture of toner particles and carrier particles, and a replenishment device for adding toner particles to the mixture, the method comprising controlling a reference parameter used in control of toner concentration in the mixture to an initial value until about a predetermined life of the developer is reached; providing programmed adjustments in the reference value in accordance with further increases in life of the developer after the developer has approximately reached its midlife; and in response to the adjustments controlling the replenishment of toner particles by the replenishment unit to control charge to mass of the toner particles in the mixture to reduce a tendency of dusting by the toner particles of the mixture due to age of the developer.

In accordance with a third aspect of the invention there is provided, an electrostatographic image forming process comprising forming an electrostatic image on an electrostatic image supporting medium; developing the electrostatic image using a developer comprising a mixture of toner particles and carrier particles; replenishing toner particles in the mixture and controlling replenishment of the toner particles in the mixture to a predetermined toner concentration, the toner concentration being controlled to a predetermined fixed aim value until about a predetermined life of the developer and then the toner concentration is adjusted to control dusting by toner particles of the mixture.

BRIEF DESCRIPTION OF THE DRAWINGS

In the detailed description of the preferred embodiments of the invention presented below, reference is made to the accompanying drawings in which.

DESCRIPTION OF THE PREFERRED EMBODIMENTS

The present invention is described below in the environment of a particular electrophotographic copier and/or printer. However, it will be noted that although this invention is suitable for use with such machines, it also can be used with other types of electrostatographic copiers and printers such as those that record images using electrography.

Because apparatus of the general type described herein are well known the present description will be directed in particular to elements forming part of, or cooperating more directly with, the present invention.

To facilitate understanding of the foregoing, the following terms are defined:

$V_B$=Development station electrode bias.

$V_O$=Primary voltage (relative to ground) on the photoconductor as measured just after the primary charger. This is sometimes referred to as the "initial" voltage.

$E_O$=Light produced by the printhead to form a discharged area on the photoconductor needed to produce a density $D_{MAX}$ or a control parameter such as current to the printhead to generate a density $D_{MAX}$.

Figure 1:
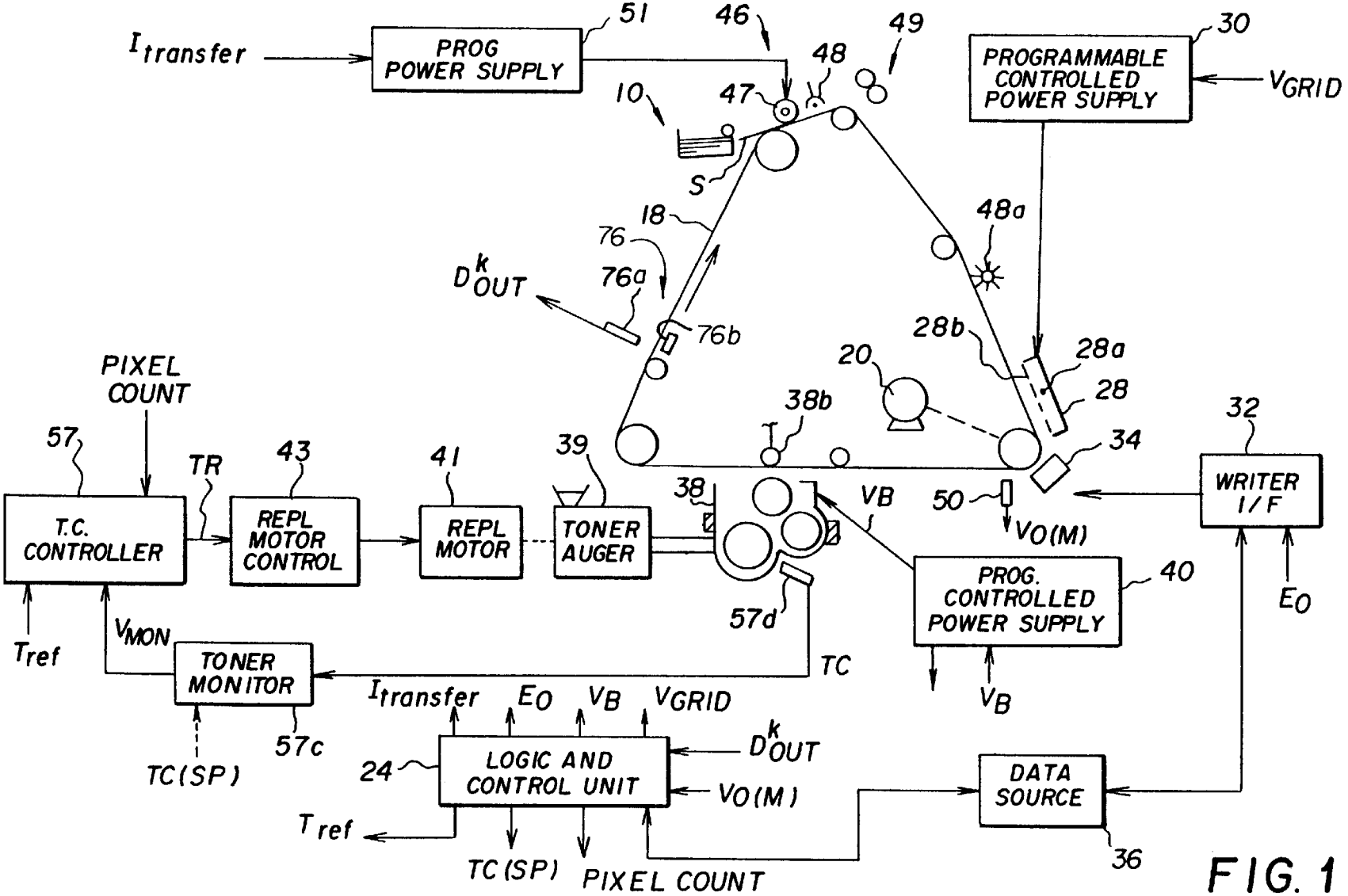
FIG. 1 is a schematic showing a side elevational view of an electrostatographic recording apparatus of the present invention.

With reference to the apparatus, machine or marking engine 10 as shown in FIG. 1, a moving primary image recording member such as photoconductive belt 18 is driven by a motor 20 past a series of work stations. The recording member may also be in the form of a drum. A logic and control unit (LCU) 24, which has a digital computer, has a stored program for sequentially actuating the various work stations.

Briefly, a charging station sensitizes belt 18 by applying a uniform electrostatic charge of predetermined primary voltage $V_O$ to the surface of the belt. The output of the charger 28 at the charging station is regulated by a programmable controlled power supply 30, which is in turn controlled by LCU 24 to adjust primary voltage $V_O$ for example through control of electrical potential ($V_{GRID}$) to a grid 28*b* that controls movement of charged particles, created by application of a relatively high voltage to the corona charging wires 28*a*, to the surface of the recording member as is well known. Other forms of known chargers may be used for depositing the uniform electrostatic charge.

At an exposure station, projected light from a write head 34 modulates the electrostatic charge on the photoconductive belt to form a latent electrostatic image of a document to be copied or printed. The write head preferably has an array of light-emitting diodes (LEDs) or other light source such as a laser or other exposure source for exposing the photoconductive belt picture element (pixel) by picture element with an intensity regulated in accordance with signals from the LCU to a writer interface 32 that includes a programmable controller. Alternatively, the exposure may be by optical projection of an image of a document or a patch onto the photoconductor. It is preferred that the same source that creates the patch used for process control to be described below also exposes the image information.

Where an LED or other electro-optical exposure source is used, image data for recording is provided by a data source 36 for generating electrical image signals such as a computer, a document scanner, a memory, a data network, etc. Signals from the data source and/or LCU may also provide control signals to a writer network, etc. Signals from the data source and/or LCU may also provide control signals to the writer interface 32 for identifying exposure correction parameters in a look-up table (LUT) for use in controlling image density. In order to form patches with density for process control purposes, the LCU may be provided with ROM memory or other memory representing data for creation of a patch that may be input into the data source 36. Travel of belt 18 brings the areas bearing the latent electrostatographic charge images past a development station 38. The toning or development station has one (more if color) magnetic brushes in juxtaposition to, but spaced from, the travel path of the belt. Magnetic brush development stations are well known. For example, see U.S. Pat. Nos. 4,473,029 to Fritz et al and 4,546,060 to Miskinis et al the contents of both of which patents are incorporated herein by reference.

LCU 24 selectively activates the development station in relation to the passage of the image areas containing latent images to selectively bring the magnetic brush into engagement with or a small spacing from the belt. The charged toner particles of the engaged magnetic brush are attracted imagewise to the latent image pattern to develop the pattern which includes development of the patches used for process control.

As is well understood in the art, conductive portions of the development station, such as conductive applicator cylinders, act as electrodes. The electrodes are connected to a variable supply of D.C. potential $V_B$ regulated by a programmable controlled power supply 40. Details regarding the development station are provided as an example, but are not essential to the invention.

A transfer station 46, as is also well known, is provided for moving a receiver sheet S into engagement with the photoconductor in register with the image for transferring the image to a receiver sheet such as plain paper.

Alternatively, an intermediate member may have the image transferred to it and the image may then be transferred to the receiver sheet. In the embodiment of FIG. 1, the transfer station includes a transfer roller 47 having one or more semiconductive layers that typically are supported on a conductive core. As an alternative to a transfer roller, a transfer belt may be used. A semiconductive layer is provided on the transfer roller. The transfer roller engages the receiver sheet in a nip formed between the transfer roller and the toner image bearing surface of the belt 18. Electrostatic transfer of the toner image is effected with a proper voltage bias applied to the transfer roller 46 so as to generate a constant current. Alternatively, a transfer corona charger may be used. Transfer may be provided by use of a brush or other charger in lieu of a roller. After transfer, the receiver sheet is detacked from the belt 18 using a detack corona charger 48 or other detacking means as is well known. A cleaning station 48 is also provided subsequent to the transfer station for removing toner from the belt 18 to allow reuse of the surface for forming additional images. In lieu of a belt a drum photoconductor or other structure for supporting an image may be used. After transfer of the unfixed toner image to a receiver sheet, the sheet is transported to a fuser station 49 where the image is fixed. As an alternative, transfer of the toner image from the primary image forming member may be made to an intermediate transfer roller or web and then to a receiver sheet. The apparatus may also provide for the creation of a second or additional color image to the receiver sheet and/or an additional image on a second side of the sheet.

The LCU provides overall control of the apparatus and its various subsystems as is well known. Programming commercially available microprocessors is a conventional skill well understood in the art. The following disclosure is written to enable a programmer having ordinary skill in the art to produce an appropriate control program for such a microprocessor. In lieu of only microprocessors the logic operations described herein may be provided by or in combination with dedicated or programmable logic devices. In order to precisely control timing of various operating stations, it is well known to use encoders in conjunction with indicia on the photoconductor to timely provide signals indicative of image frame areas and their position relative to various stations. Other types of control for timing of operations may also be used.

Process control strategies generally utilize various sensors to provide real-time control of the electrostatographic process and to provide "constant" image quality output from the user's perspective.

One such sensor may be a densitometer 76 to monitor development of test patches preferably in non-image areas of photoconductive belt 18, as is well known in the art. However, the invention may be used where density is recorded with an image frame. The densitometer may include an infrared LED 76*a* which shines light through the belt or is reflected by the belt onto a photodiode 76*b* or other light detector. Typically, where the belt is substantially or generally transparent to the light, density is determined using transmission and, where the belt is substantially or generally non-transparent to the light, density is determined using reflection. An example of a preferred densitometer is described in U.S. application Ser. No. 09/090,746, filed Jun. 4, 1998 in the names of Philip Stern et al. The patch density may be periodically changed so that it is sometimes at the high density end of the tone scale ($D_{MAX}$) and at other times it is at one or more intermediate tone scales. A densitometer signal with high signal-to-noise ratio and used with a primary image forming member such as a photoconductor that is relatively transparent to infrared light is preferred, but a lower nominal density level and/or a reflection densitometer would be reasonable alternatives in other configurations. The photodiode generates a voltage proportional to the amount of light received. This voltage is compared to the voltage generated due to transmittance or reflectance of a bare patch, to give a signal representative of an estimate of toned density. This signal $D^k_{OUT}$ may be used to adjust $V_O$, $E_O$, and/or $V_B$ The reference indicium k refers to the contone level or target density of the patch which the printhead was provided with data to generate. Thus, for printing a $D_{MAX}$ patch, grey level data for exposing pixels at level 15 is provided in a 4 bits/pixel system. The use of 4 bits/pixel is used as an example and can define pixels of grey levels from 0–15 wherein 0 in this case is least dense and 15 is most dense. Periodically, exposures at intermediate grey levels 5 and 10 will also be made to generate patches of density lower than $D_{MAX}$.

In the preferred embodiment, a schedule for generating patches is provided for controlling the grey levels of patches as well as their frequency of occurrence and individual repetition. The resulting density signal is used to detect changes in density of a measured patch to control primary voltage $V_O$, exposure $E_O$, bias voltage $V_B$ and/or transfer current as is, for example, described in U.S. application Ser. No. 08/998,787 filed in the names of Regelsberger et al. To do this, in general, $D^k_{OUT}$ is compared with a signal $D^k_{SP}$ representing a setpoint density value for a patch of contone level k and differences between $D^k_{OUT}$ and $D^k_{SP}$ cause the LCU to change settings of $V_{GRID}$ on primary charging station 28 and adjust exposure $E_O$ through modifying exposure duration or light intensity for recording a pixel. Adjustment to the potential $V_B$ at the development station is also provided for. Feedback of primary voltage $V_O$ through measurements using an electrometer 50 is also used in the process control algorithm.

In a two-component developer provided in development or toning station 38, toner gets depleted with use whereas magnetic carrier particles remain thereby affecting the toner concentration in the development station. The toner particles are typically comprised of dry insulative plastic material that includes pigment and optionally charge control agents. Silica particles or other third component addenda may also be in the developer mixture and adhere to the surface of the toner particles as is well known. Addition of toner to the development station may be made from a toner replenisher device 39 that includes a source of toner and a toner auger for transporting the toner to the development station. A replenishment motor 41 is provided for driving the auger. A replenishment motor control circuit 43 controls the speed of the auger as well as the times the motor is operating and thereby controls the feed rate and the times when toner replenishment is being provided. Typically, the motor control 43 operates at various adjustable duty cycles that are controlled by a toner replenishment signal TR that is input to the replenishment motor control 43. Typically, the signal TR is generated in response to a detection by a toner monitor of a toner concentration (TC) that is less than that of a setpoint value. For example, a toner monitor probe 57*d* is a transducer that is located or mounted within or proximate the development station and provides a signal TC related to toner concentration. This signal is input to a toner monitor which in a conventional toner monitor causes a voltage signal $V_{MON}$ to be generated in accordance with a predetermined relationship between $V_{MON}$ and TC (see FIGS. 2A and 4). The voltage $V_{MON}$ is then compared with a reference voltage, $T_{ref}$, of say 2.2 volts which would be expected for a desired toner concentration of say 10%. Differences of $V_{MON}$ from this reference voltage are used to adjust the rate of toner replenishment or the toner replenishment signal TR. In a more adjustable type of toner monitor such as one manufactured by Hitachi Metals, Ltd., the predetermined relationship between TC and $V_{MON}$ offers a range of relationship choices (see FIGS. 2B and 3). With such monitors, a particular parametric relationship between TC and $V_{MON}$ may be selected in accordance with a voltage input representing a toner concentration setpoint signal value, TC(SP). Thus, changes in TC(SP) can affect the rate of replenishment by affecting how the system responds to changes in toner concentration that is sensed by the toner monitor. As noted in FIGS. 2A and 2B, the LCU 24 can be used to generate the reference signals and respond to inputs from the toner monitor to generate the replenishment signal. Other calculating devices may also be used in lieu of a microcomputer.

Figure 2A:
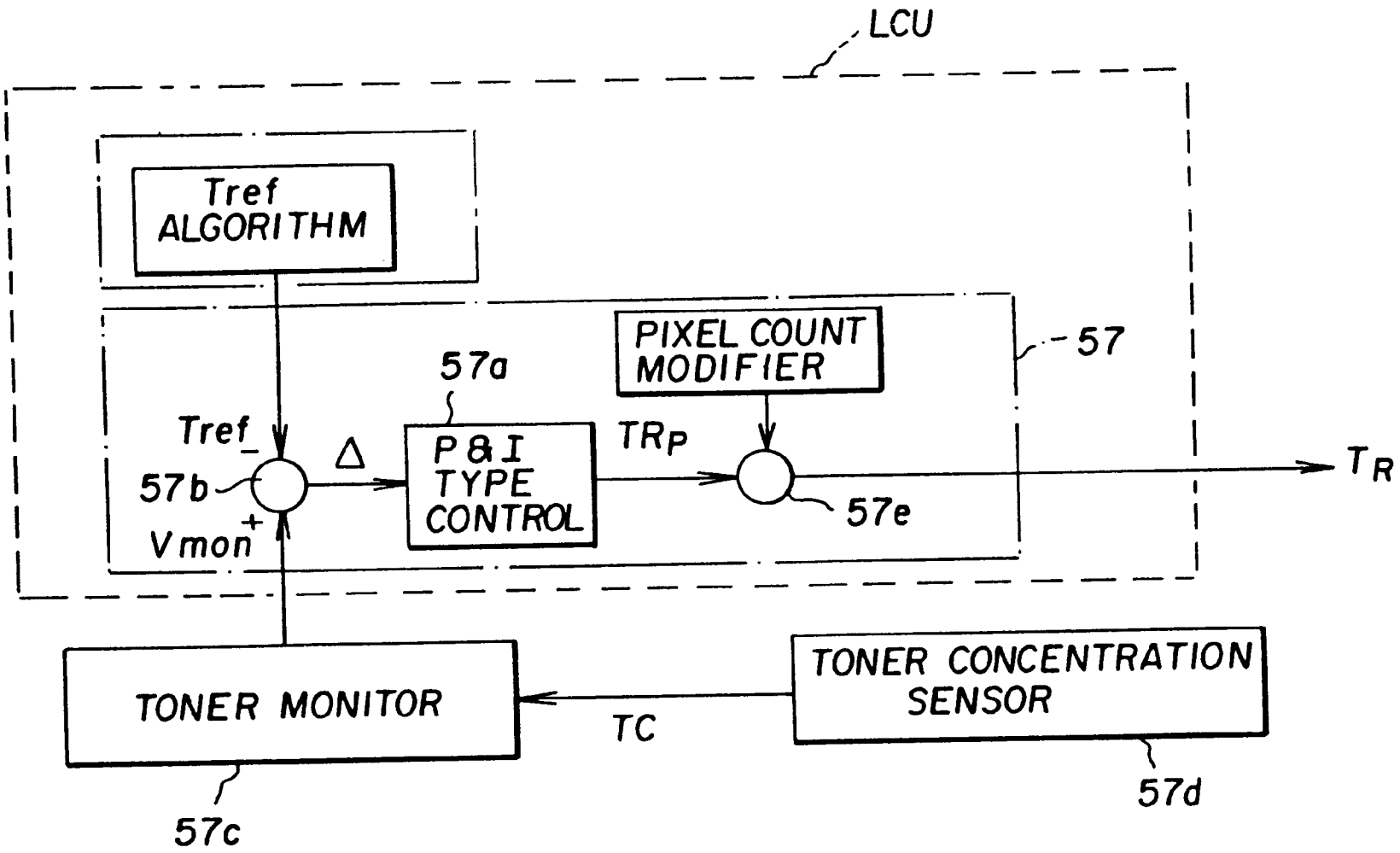
FIGS. 2A and 2B are alternative schematics of a toner concentration (TC) controller for use in the apparatus of the invention.
Figure 2B:
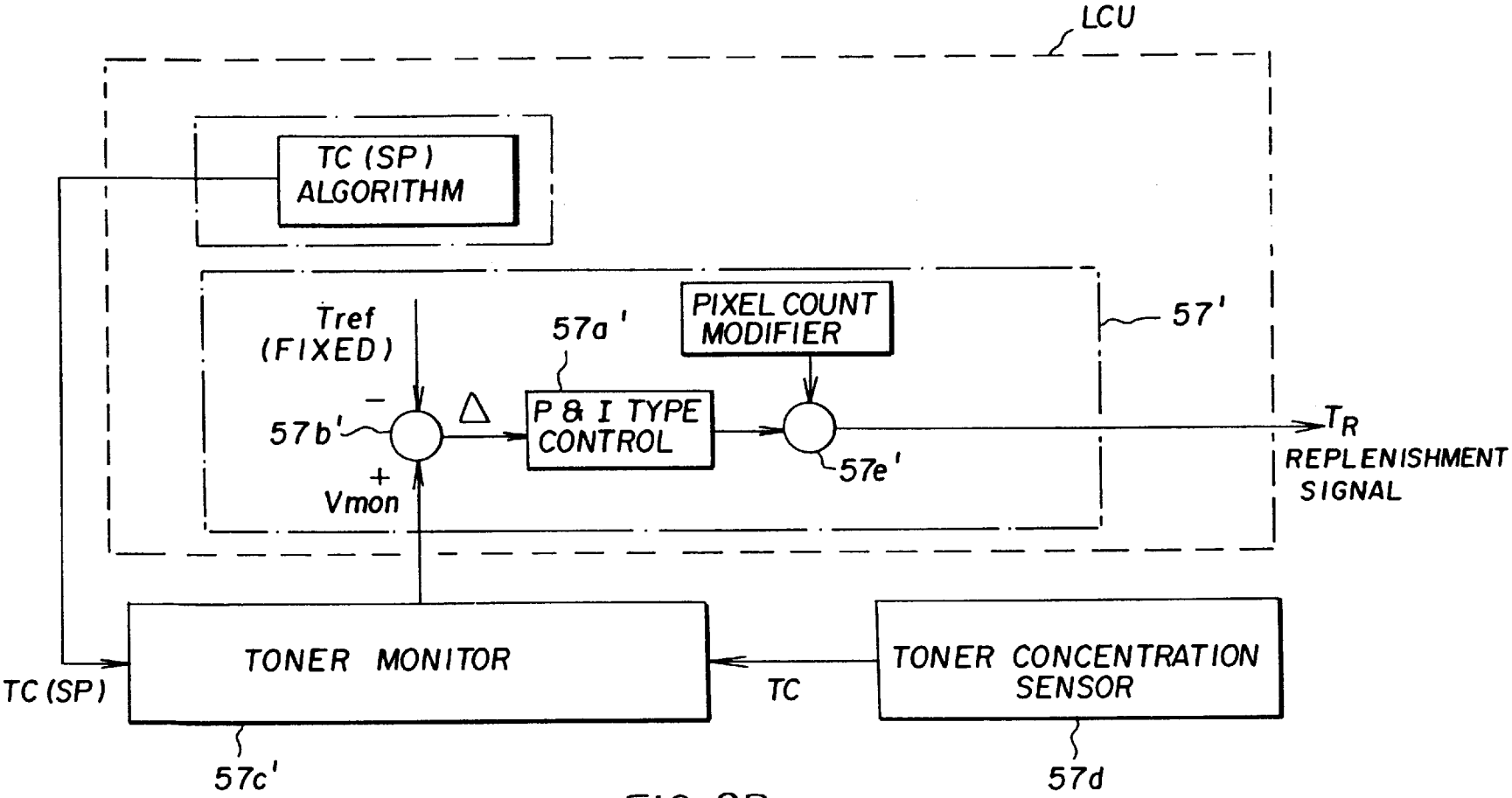

With reference to FIG. 2A the signal $V_{MON}$ is compared by a comparator 57*b* with the signal $T_{ref}$ and a difference signal Δ is input to a proportional plus integral (P+I) type controller 57*a* or algorithm that operates as such a controller. The P+I controller is tuned for a relatively fast response to input signals Δ. Like $V_{MON}$, Δ may change quickly owing to print-to-print variation in toner usage. The output from the P+I controller 57*a* represents a preliminary toner replenishment signal TRp. The signal TRp may be modified in block 57*e* with a signal that provides adjustment for toner take out based on pixel count to generate the replenishment signal TR. Where the exposure system relies on electro-optical exposure of the photoconductive belt the take out of toner will be related to the number of pixels exposed, assuming that this is a discharged area development process. Where the electro-optical exposure source is of a gray level or multibits per pixel, the count signal may keep track of accumulating grey level exposures and weigh the count accordingly so as to be related to toner take out. The use of pixel counting to modify a toner replenishment signal is known, as discussed in U.S. Pat. No. 5,649,266, and is considered to be optional to the process and apparatus of this invention.

In operation of the apparatus and method of the invention, a scheduled reduction in toner concentration is affected by providing scheduled increments in $T_{ref}$ but only starting after a predetermined breakpoint or number of image frames (for example, 200,000 image frames) processed by the developer composition; i.e., the carrier particles since new toner particles are added as image frames are developed. This toner concentration breakpoint is scheduled to be the time when conditions are just becoming likely for dusting, hollow character, print background or post-transfer image disruptions at low toner charge. The scheduled reduction in toner concentration is stepwise implemented by a scheduled stepwise raising of $T_{ref}$ so as prints are being made, the toner concentration is allowed to fall. With lowering of toner concentration, the toner charge (Q/m) increases and conditions of dusting, hollow character, print background, and post-transfer image disruptions are better controlled. While equal stepwise changes in $T_{ref}$ are preferred other types of changes may also be used.

Figure 5:
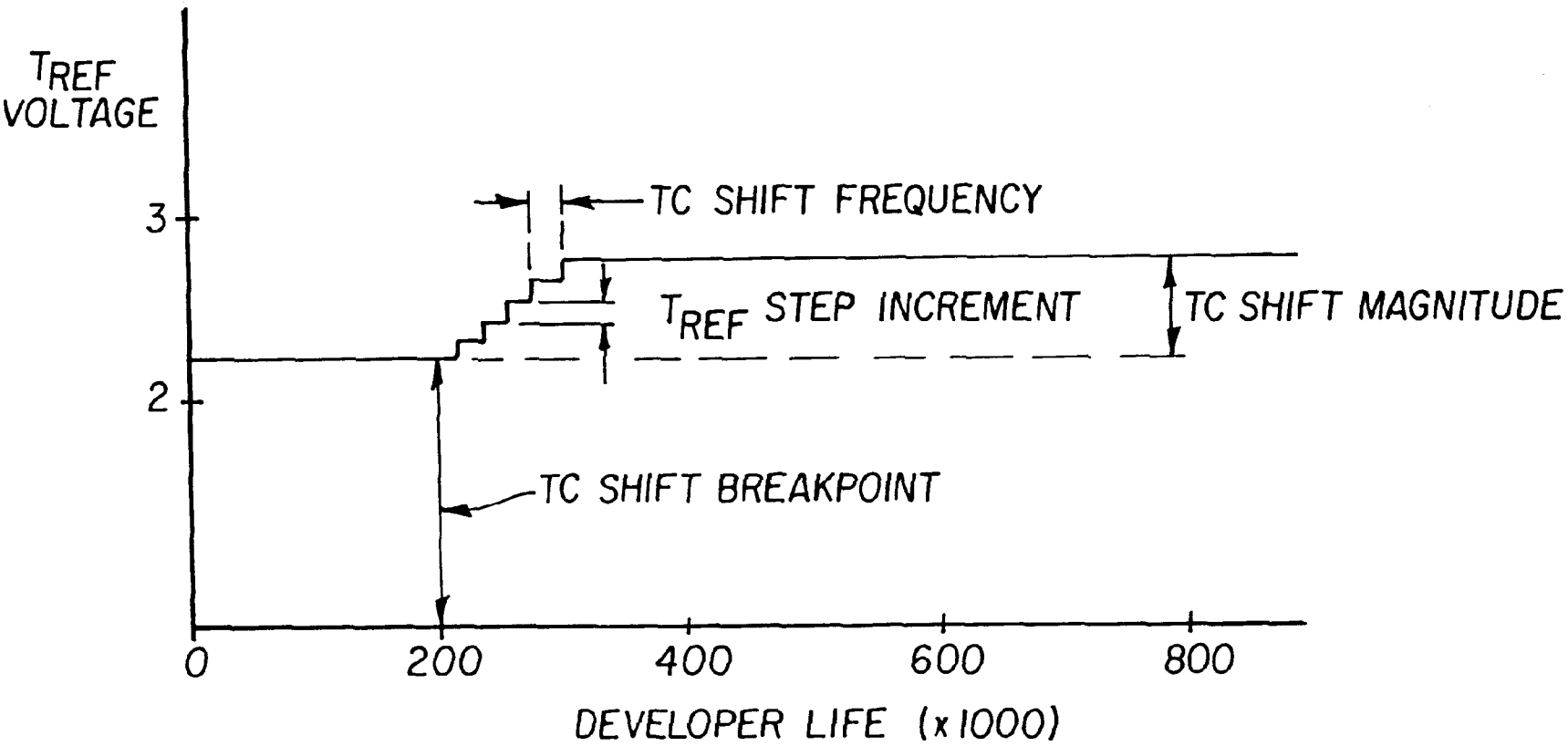
FIG. 5 is a graph illustrating a relationship between a toner concentration reference control signal $T_{ref}$ and developer life in the apparatus of FIG. 1.

The invention developed to implement a shift in toner concentration with developer life has the following features:

1. A software counter to track the life of the developer is automatically reset to zero when the service program to remove the old developer is run to completion. This eliminates errors in estimating developer life due to service personnel forgetting to reset the developer life counter when replacing developer.
2. The shift in toner concentration is accomplished by adjusting a reference voltage (referred to as $T_{ref}$ in one embodiment and toner concentration setpoint, TC(SP), in a second embodiment) to induce a corresponding change in toner concentration. Increasing the value of $T_{ref}$, results in a shift of the operating aim point of toner concentration to a lower value.
3. The initial selection of the toner monitor reference voltage ($T_{ref}$) is chosen to center the range for $T_{ref}$ within the dynamic range of toner monitor. The initial setpoint for $T_{ref}$ is offset below the center of the toner monitor dynamic range by a value equal to ½ of the intended magnitude of the shift to induce the toner concentration aim point shift.
4. The algorithm to shift the operating aim point of toner concentration reduces the concentration in a controlled manner during mid-life of the developer. The toner concentration shift thus doesn't occur uniformly over the life of the developer. (See FIG. 5)
5. The algorithm to shift the toner concentration life has three programmable coefficients to control the characteristic of the toner concentration shift (See FIG. 5). These coefficients are defined as:
   a. TC Shift Breakpoint—Defines the point in life at which the shift in the operating aim point of toner concentration begins.
   b. TC Shift Magnitude—Defines the overall amount of change to the $T_{ref}$ value used to shift the operating aim point of toner concentration. The TC Shift Magnitude may be applied in 6 adjustments, each equal to the TC Shift Magnitude/6.
   c. TC Shift Frequency—Defines the number of images run between incremental or stepwise shifts to the $T_{ref}$ voltage or value. Since the TC Shift Magnitude is made in 6 equal adjustments, the number of images to complete the TC shift would equal 6*TC Shift Frequency. Note that more or fewer than six adjustments may be provided.
6. The shift of $T_{ref}$ would only occur after the machine has cycled out at the end of a run. Shifts of $T_{ref}$ are only made if the replenishment algorithm indicates TC in normal state, i.e. not in an abnormal range and recovering from a toner bottle change.

Figures 6, 6A:
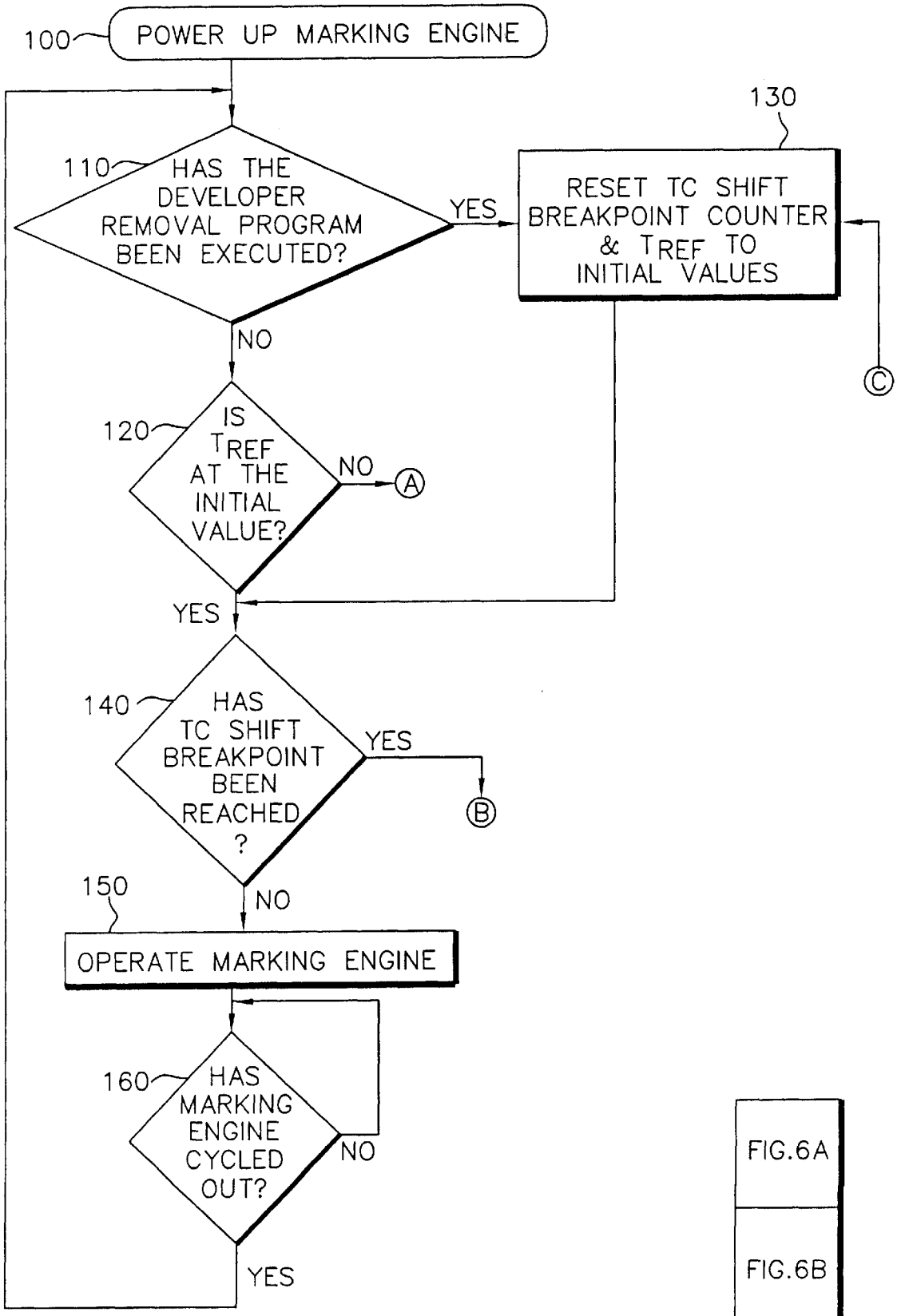
FIGS. 6, 6A and 6B are a flow chart of operation of the apparatus and method of the present invention for effecting control of toner charge to mass in operation of the apparatus of FIG. 1.
Figure 6B:
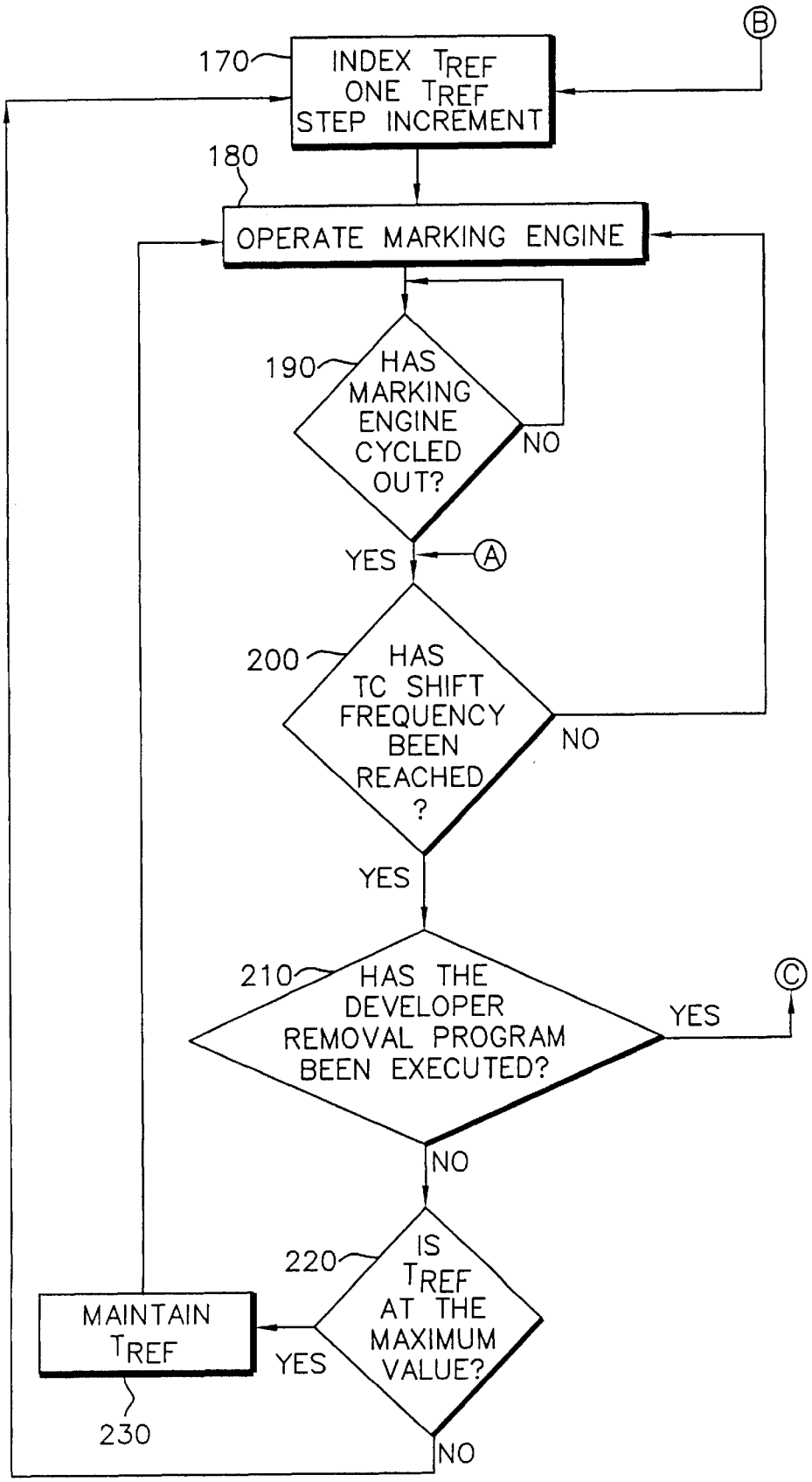

To implement the programmable control of $T_{ref}$ reference may be had to the flow chart of FIGS. 6, 6A and 6B. A programmed set of instructions operating in accordance with the flow chart may be provided in the logic and control unit 24. In step 100 power up of the marking engine 10 is made for a production run; i.e., for forming prints or copies of images. The program provides an initial inquiry if the developer removal program has been executed since the last cycling out of the apparatus, step 110. A register may be provided in the LCU 24 for recording whether or not such has occurred. If the answer is no, an inquiry is made as to whether or not $T_{ref}$ is at the initial value; e.g. 2.2 volts, step 120. The value of $T_{ref}$ at the last cycling down of the marking engine is also stored in a register in the LCU 24. In step 130 if the answer to the inquiry in step 110 is yes, i.e. a developer removal program was executed, a toner concentration shift breakpoint counter is reset and $T_{ref}$ is adjusted to its initial value. Thus, the counter in the LCU that counts processed image frames since the last developer removal program was executed is reset to zero.

An example of a developer removal program is a routine where an operator or service person is instructed through a series of steps involving removal of developer from the developer housing. In such a routine, instructions can be provided from a program in the LCU that instructs the operator or a service person to install a special developer removal hose and initiate a developer routine that runs the mixing elements in the development chamber. As the mixing elements are rotated, a vacuum is operated to remove developer from the chamber and through the developer removal hose for say three minutes. At the end of three minutes of applied vacuum, as determined by the LCU 24, the program automatically assumes that the developer removal program has been executed.

With $T_{ref}$ at the initial value the flow chart next proceeds to step 140 wherein inquiry is made as to whether or not the toner concentration shift breakpoint has been reached. As noted above this breakpoint count is set to define the point in life of the developer at which a shift in the operating toner concentration is designed to begin and is advantageously made at about midlife of the developer. If the answer to the inquiry of step 140 is no; i.e. for this example breakpoint count is below 200 k image frames processed, the decision is made to operate the marking engine to form prints or copies, step 150. When the marking engine cycles out; i.e. no more prints or copies to be made, the program returns to step 110 and repeats. If the answer to the inquiry in step 140 is yes; i.e. shift breakpoint count is reached, the program steps to step 170 wherein the value of $T_{ref}$ stored at the last cycling out is indexed or incremented one $T_{ref}$ step increment, which in this example is 0.1 volts. After incrementing $T_{ref}$ by one increment the marking engine is operated to make prints or copies, step 180. During this operation counting of image frames continues. When the marking engine cycles out, step 190, inquiry is made in step 200 as to whether or not the TC Shift Frequency has been met. Note: that this inquiry is made after cycling out so that there is never an adjustment to $T_{ref}$ during a production run since this could provide inconsistency between prints made during the run. The TC Shift Frequency is a fixed number of prints since the last change in $T_{ref}$ and is determined to have been reached by storing the print count at the last change of $T_{ref}$ and subtracting this count from the current count and comparing the difference value obtained with the stored shift frequency value. A nominal value for shift frequency is 10,000 image frames; however, values in the range of 5000 to 50,000 image frames would be typical. If the answer is no in step 200, the marking engine operates without change to $T_{ref}$, step 180. If the shift frequency value has been reached or exceeded, inquiry is made in step 210 as to whether or not a developer removal program was executed. If yes, the program returns to step 130 implying that $T_{ref}$ and the breakpoint counter are set to initial values. After the initial values are assigned to $T_{ref}$ and the breakpoint counter the process repeats starting at step 140. If the answer to the inquiry of step 210 is no, inquiry is made at step 220 as to whether or not $T_{ref}$ is a maximum value; e.g. 2.8 volts. If yes, maximum $T_{ref}$ is retained, step 230, and the marking engine is operated to make prints or copies, step 180. If the answer to the inquiry of step 220 is no, $T_{ref}$ is indexed one step increment.

With the above process for adjustment of $T_{ref}$, the objectives of the invention are met with implementation of the features of the invention as set forth above. The programmable control of $T_{ref}$ assumes that measured TC indicates TC remains under control and is not abnormally dropping. Also, when a new toner bottle is placed in the machine, the machine is allowed to run without shifting $T_{ref}$ until TC returns to a normal state.

Figure 3:
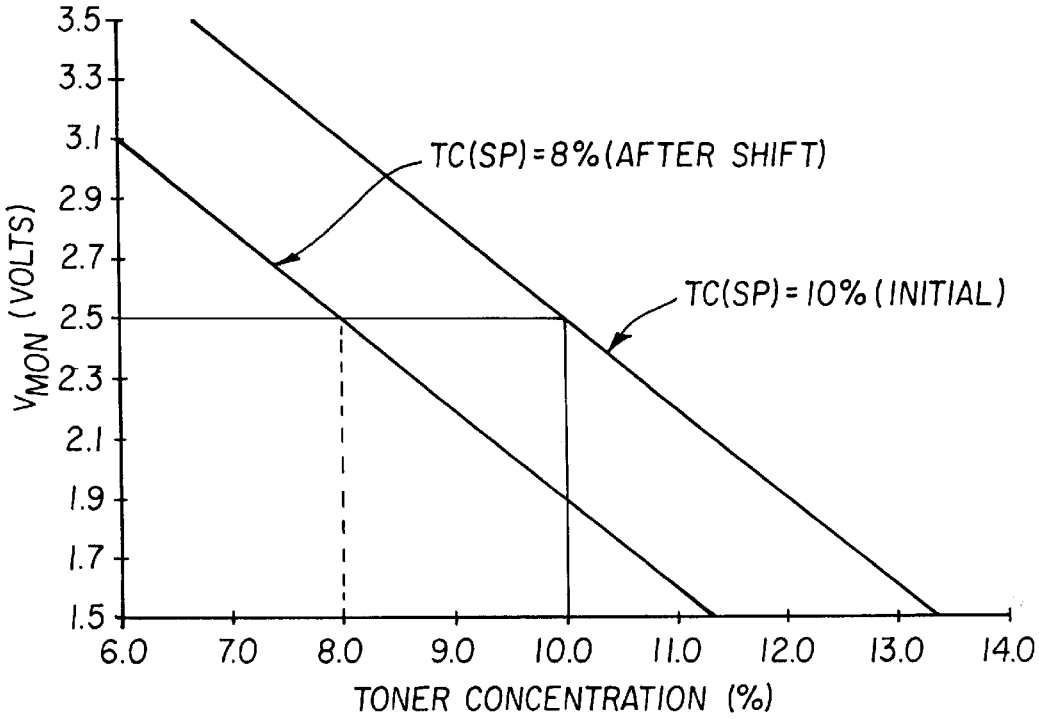
FIGS. 3 and 4 are graphs illustrating a relationship between TC and a signal output by a TC monitor in accordance with the prior art.
Figure 4:
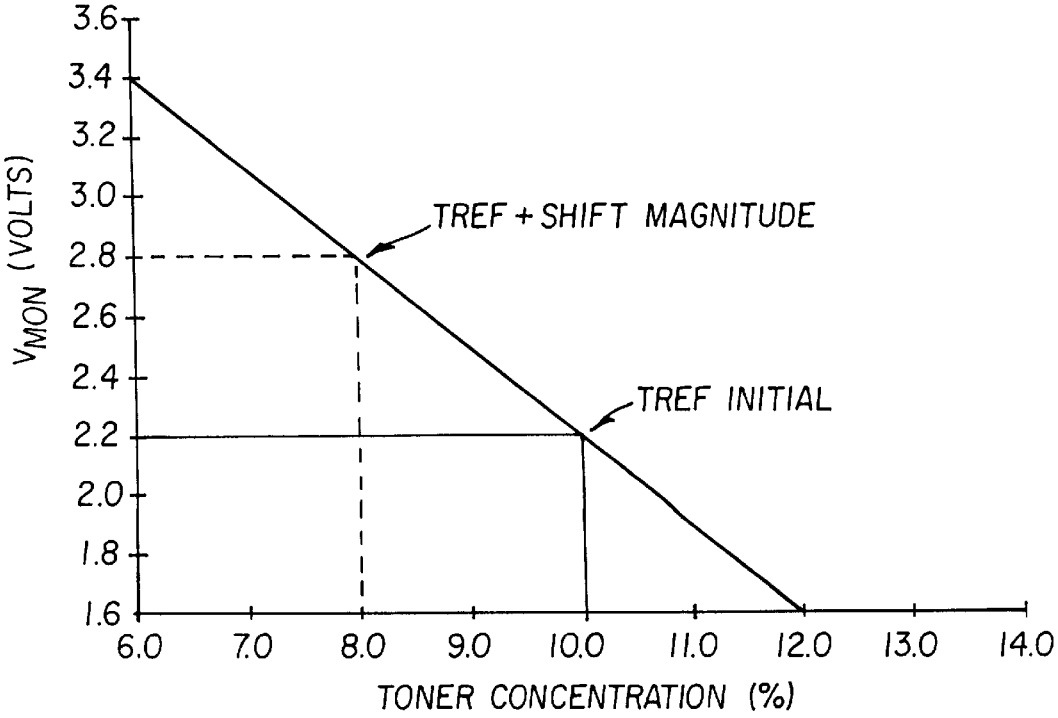

The method and apparatus described may also be used with a toner monitor 57*c*' of the type having a characteristic illustrated in FIG. 3 (FIG. 2B embodiment wherein a prime indicates a corresponding function to that of the corresponding structure of the embodiment of FIG. 2A); i.e., a parametrically adjustable relationship is provided between output voltage $V_{MON}$ and the measured TC. Where such a toner monitor is used, the adjustable signal $T_{ref}$ internal to the logic and control unit may be replaced by an analog control voltage output to the toner monitor as TC(SP) to change its input/output characteristic. Since signals $T_{ref}$ and TC(SP) both can be used to affect the toner concentration, both signals can be used cooperatively or alternately. The use of such a toner monitor is described in U.S. Pat. No. 5,649,266, the pertinent contents of which are incorporated herein by reference. The use of either one of these toner monitors (FIG. 3 or FIG. 4 characteristics) recognizes that the adjustment of $T_{ref}$ or TC(SP), either of which is considered a reference signal as the term is used herein, needs to be limited to the practical upper and lower operating limits for the toning process. It will be understood that print-to-print changes in toner concentration are corrected by normal toner monitor control wherein changes to TC cause $V_{MON}$ to change and thus create a change to Δ. The replenishment signal TR that is generated in response to a change in Δ causes the replenishment motor control 43 to activate the replenishment motor 41 which drives the toner auger 39 to add toner to the replenishment station. However, once the mid-life age of the developer mixture is reached, adjustments are made to $T_{ref}$ or TC(SP) or both to cause toner charge (Q/m) to return to the preferred operating range to reduce the tendency of dusting in the toner particles.

The invention has been described in detail with particular reference to preferred embodiments thereof, but it will be understood that variations and modifications can be effected within the spirit and scope of the invention.

What is claimed is:

1. For use in an electrostatographic machine wherein images are formed on an electrostatic image supporting medium and developed by a development station having a developer formed of a mixture of toner particles and carrier particles and a replenishment device for adding toner particles to the mixture, the machine including apparatus for controlling charge to mass of the toner particles in the mixture, the apparatus comprising:

a controller that is operational to control a reference parameter used in control of concentration of toner in the mixture, the controller controlling the reference parameter to an initial value to establish a value for an initial operating aim point of toner concentration until about a predetermined life of the developer is reached, the controller being programmed to provide adjustments in the reference parameter in accordance with further increases in life of the developer and in response to the adjustments the controller controls the replenishment of toner particles by the replenishment unit by adjusting the operating aim point of toner concentration to a value different than the value for an initial operating aim point of toner concentration to control charge to mass of the toner particles in the mixture to reduce a tendency of dusting by the toner particles in the mixture due to age of the developer.

2. The apparatus of claim 1 wherein the controller stores a count value representing a point in life of the developer at which a shift in operating aim point of toner concentration begins.

3. The apparatus of claim 2 wherein the controller is programmed to reset a count value of developer life automatically in response to replacement of the developer.

4. The method of claim 1 wherein the controller is programmed to reset a count value of developer life automatically in response to replacement of the developer.

5. A method for use in an electrostatographic process wherein images are formed on an electrostatic image supporting medium and developed by a development station having a developer formed of a mixture of toner particles and carrier particles, and a replenishment device for adding toner particles to the mixture, the method comprising:

controlling a reference parameter used in control of toner concentration in the mixture to an initial value to establish a value for an initial operating aim point of toner concentration until about a predetermined life of the developer is reached;

providing programmed step adjustments in the reference value in accordance with further increases in life of the developer after the developer has approximately reached its midlife; and in response to the step adjustments controlling the replenishment of toner particles by the replenishment unit by adjusting the operating aim point of toner concentration to a value different than the value for an initial operating aim point of toner concentration to control charge to mass of the toner particles in the mixture to reduce a tendency of dusting by the toner particles of the mixture due to age of the developer.

6. The method of claim 5 and including storing a count value representing a point in life of the developer at which a shift in operating aim point of toner concentration begins.

7. The method of claim 6 and including resetting the count value of developer life automatically in response to replacement of the developer.

8. The method of claim 5 and including resetting a count value of developer life automatically in response to replacement of the developer.

9. The method of claim 5 and including resetting a count value of developer life in response to replacement of the developer.

10. An electrostatographic image forming process comprising:

forming an electrostatic image on an electrostatic image supporting medium;

developing the electrostatic image using a developer comprising a mixture of toner particles and carrier particles;

replenishing toner particles in the mixture and controlling replenishment of the toner particles in the mixture to a predetermined toner concentration, the toner concentration being controlled initially to a predetermined fixed toner concentration aim value until about a predetermined life of the developer and then toner concentration aim value is changed so that the toner concentration is adjusted to control dusting by toner particles of the mixture.

11. The process of claim 10 and including resetting a count value of developer life automatically in response to replacement of developer.

12. The process of claim 11 and including storing a count value representing a point in life of the developer at which a shift in operating aim point of toner concentration begins.

13. The process of claim 12 and including resetting a count value of developer life automatically in response to replacement of the developer mixture.

14. The process of claim 12 and including resetting a count value of developer life in response to replacement of the developer mixture.

15. The process of claim 10 wherein control of toner concentration is provided by maintaining constant a reference value used in controlling aim point of toner concentration and adjusting the reference value in stepwise changes after about a midlife of the developer is reached.

16. The method of claim 5 wherein the operating aim point of toner concentration after an adjustment is lower than an operating aim point of toner concentration prior to an adjustment.

17. The method of claim 10 wherein the toner concentration aim value is changed to a value lower than the initial toner concentration aim value.

18. The apparatus of claim 1 wherein the operating aim point of toner concentration is lower after an adjustment than the operating aim point prior to an adjustment.

* * * * *